US005343118A

United States Patent [19]

Chang

[11] Patent Number: 5,343,118

[45] Date of Patent: Aug. 30, 1994

[54] IODINE GETTER FOR A HIGH INTENSITY METAL HALIDE DISCHARGE LAMP

[75] Inventor: Hsueh-Rong Chang, Scotia, N.Y.

[73] Assignee: General Electric Company, Schenectady, N.Y.

[21] Appl. No.: 92,539

[22] Filed: Jul. 16, 1993

Related U.S. Application Data

[63] Continuation of Ser. No. 814,522, Dec. 30, 1991, abandoned.

[51] Int. Cl.[5] ..... H01J 17/20; H01J 61/18

[52] U.S. Cl. ..... 313/637; 313/638; 313/161; 313/562; 315/248

[58] Field of Search ..... 313/556, 555, 562, 640, 313/637, 635, 161, 638; 315/248, 344

[56] References Cited

U.S. PATENT DOCUMENTS

| | | | |
|---|---|---|---|
| 3,350,598 | 10/1967 | Corbin et al. | 313/635 |
| 3,377,498 | 4/1968 | Koury et al. | 313/635 |
| 3,852,630 | 12/1974 | Wesselink et al. | 313/640 |
| 3,959,682 | 5/1976 | Wesselink et al. | 313/640 |
| 4,612,475 | 9/1986 | Downing | 313/640 |
| 4,801,846 | 1/1989 | Kramer et al. | 313/640 X |
| 4,810,938 | 3/1989 | Johnson et al. | 313/638 X |
| 4,812,702 | 3/1989 | Anderson | 313/153 |
| 4,935,668 | 6/1990 | Hansler et al. | 313/640 X |
| 4,972,120 | 11/1990 | Witting | 313/638 |
| 5,032,757 | 7/1991 | Witting | 313/635 X |
| 5,039,903 | 8/1991 | Farrall | 313/160 |

*Primary Examiner*—Donald J. Yusko
*Assistant Examiner*—Ashok Patel
*Attorney, Agent, or Firm*—Jill M. Breedlove; Marvin Snyder

[57] ABSTRACT

A high intensity discharge lamp having a fill including at least one rare earth metal iodide has an additional metal component for avoiding a substantial loss of the metal component of the fill and the attendant substantial buildup of free iodine, thereby increasing the useful life of the lamp. During lamp operation, the additional metal component combines with iodine in the vapor phase, forming a relatively stable iodide and thus reducing the total level of free iodine in the lamp. As a result, arc instability is avoided. The additional metal component also emits visible light and hence improves efficacy. Moreover, the additional metal component does not attack the arc tube wall by reducing silica. Suitable additional metal components include indium and thallium.

5 Claims, 1 Drawing Sheet

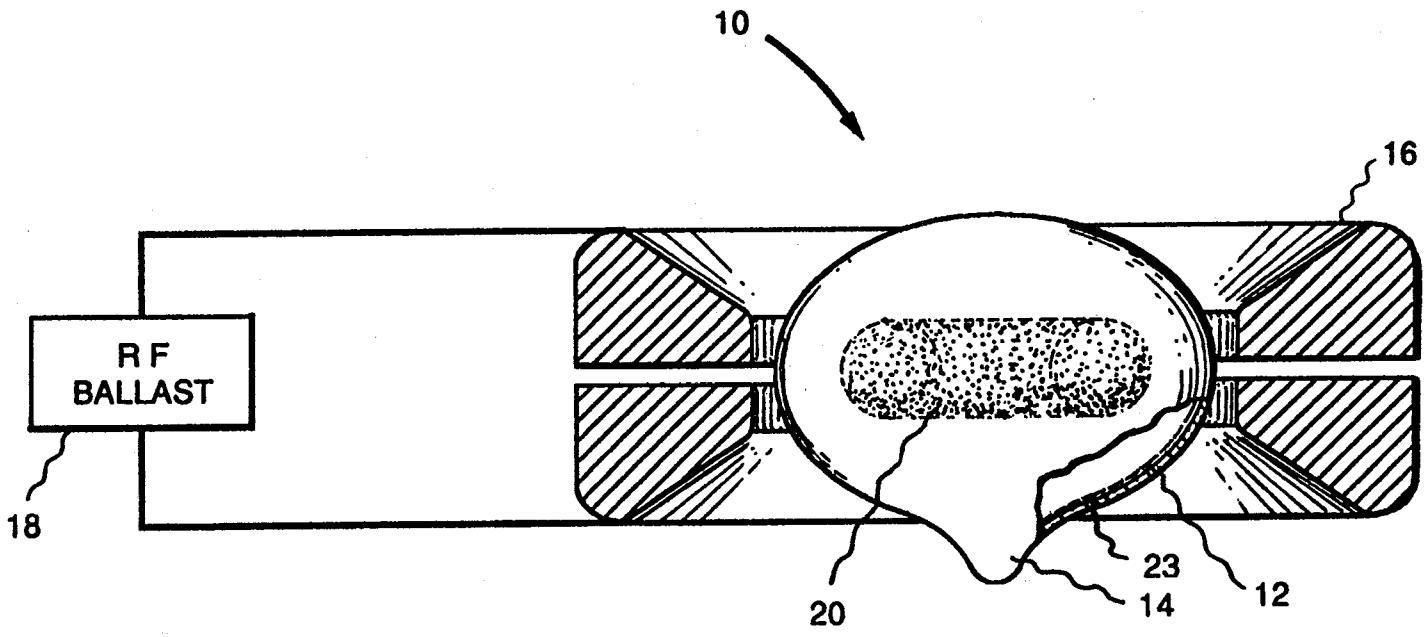
10
16
12
23
14
20
RF
BALLAST
18

IODINE GETTER FOR A HIGH INTENSITY METAL HALIDE DISCHARGE LAMP

This application is a Continuation of application Ser. No. 07/814,522, filed Dec. 30, 1991, now abandoned.

FIELD OF THE INVENTION

The present invention relates generally to high intensity, metal halide discharge lamps and, more particularly, to an improved metal iodide fill for such a lamp including an iodine getter.

BACKGROUND OF THE INVENTION

In operation of a high intensity metal halide discharge lamp, visible radiation is emitted by the metal portion of the metal halide fill at relatively high pressure upon excitation typically caused by passage of current therethrough. One class of high intensity, metal halide lamps comprises electrodeless lamps which generate an arc discharge by establishing a solenoidal electric field in the high-pressure gaseous lamp fill comprising the combination of one or more metal halides and an inert buffer gas. In particular, the lamp fill, or discharge plasma, is excited by radio frequency (RF) current in an excitation coil surrounding an arc tube which contains the fill. The arc tube and excitation coil assembly acts essentially as a transformer which couples RF energy to the plasma. That is, the excitation coil acts as a primary coil, and the plasma functions as a single-turn secondary. RF current in the excitation coil produces a time-varying magnetic field, in turn creating an electric field in the plasma which closes completely upon itself, i.e., a solenoidal electric field. Current flows as a result of this electric field, thus producing a toroidal arc discharge in the arc tube.

High intensity, metal halide discharge lamps, such as the aforementioned electrodeless lamps, generally provide good color rendition and high efficacy in accordance with the principles of general purpose illumination. However, the lifetime of such lamps can be limited by degradation of the arc tube by chemical attack due to ambipolar diffusion. In particular, during lamp operation, the metal halide component of the fill is dissociated and ionized in the arc. By the process of ambipolar diffusion, the positive metal ions are driven towards the arc tube wall by the electric field of the arc column, while the negative halogen ions are retarded from diffusing to the wall. As a result, during initial lamp operation, more metal ions than halogen ions reach the quartz wall of the arc tube. This causes an excess flow of metal atoms (both neutral and ionized) to the quartz wall, resulting in a chemical reaction between the metal and the quartz, which leads to the loss of metal atoms. Disadvantageously, the loss of metal atoms leads to the release of free halogen into the arc tube, which may build up to a level that is high enough to cause arc instability and eventual arc extinction, especially in electrodeless high intensity, metal halide discharge lamps. In addition, the loss of metal atoms shortens the useful life of the lamp by reducing the visible light output.

Accordingly, it is desirable to prevent a substantial loss of the metal component of the metal halide fill and the attendant substantial buildup of free halogen in a high intensity, metal halide discharge lamp.

SUMMARY OF THE INVENTION

A high intensity discharge lamp having a fill including at least one rare earth metal iodide has an additional metal component for avoiding a substantial loss of the metal component of the fill and the attendant substantial buildup of free iodine, thereby increasing the useful life of the lamp. During lamp operation, the additional metal component combines with iodine in the vapor phase, forming a relatively stable iodide and thus reducing the total level of free iodine in the lamp. As a result, arc instability is avoided. The additional metal component according to the present invention also emits visible light and hence improves efficacy. Moreover, the additional metal component does not attack the arc tube wall by reducing silica. Suitable additional metal components according to the present invention include indium, which emits blue light and combines with iodine to form indium iodides, and thallium, which emits green light and combines with iodine to form thallium iodides.

BRIEF DESCRIPTION OF THE DRAWINGS

The features and advantages of the present invention will become apparent from the following detailed description of the invention when read with the sole accompanying drawing FIGURE which illustrates a high intensity discharge lamp in accordance with the present invention.

DETAILED DESCRIPTION OF THE INVENTION

The sole drawing FIGURE illustrates a high intensity discharge lamp 10 having a fill including at least one rare earth metal iodide and employing an iodine getter in accordance with the present invention. For purposes of illustration, lamp 10 is shown as an electrodeless, high intensity, metal iodide discharge lamp. However, it is to be understood that the principles of the present invention apply equally well to high intensity discharge lamps having electrodes. As shown, electrodeless discharge lamp 10 includes an arc tube 14 formed of a high temperature glass, such as fused silica. By way of example, arc tube 14 is shown as having a substantially ellipsoid shape. However, arc tubes of other shapes may be desirable, depending upon the application. For example, arc tube 14 may be spherical or may have the shape of a short cylinder, or "pillbox", having rounded edges, if desired.

Arc tube 14 contains a fill, including at least one rare earth metal iodide, in which a solenoidal arc discharge is excited during lamp operation. A suitable fill comprises sodium iodide, cerium iodide and xenon combined in weight proportions to generate visible radiation exhibiting high efficacy and good color rendering capability at white color temperatures. Such a fill is described in commonly assigned U.S. Pat. No. 4,810,938 of P. D. Johnson, J. T. Dakin and J. M. Anderson, issued on Mar. 7, 1989, which is incorporated by reference herein. Another suitable fill comprises a combination of lanthanum iodide, sodium iodide, cerium iodide, and xenon, as described in commonly assigned U.S. Pat. No. 4,972,120 of H. L. Witting, issued Nov. 20, 1990, which patent is incorporated by reference herein.

Electrical power is applied to the HID lamp by an excitation coil 16 disposed about arc tube 14 which is driven by an RF signal via a ballast 18. A suitable excitation coil 16 may comprise, for example, a two-turn coil having a configuration such as that described in commonly assigned U.S. Pat. No. 5,039,903 of G. A. Fartall, issued Aug. 13, 1991, which patent is incorporated by reference herein. Such a coil configuration results in very high efficiency and causes only minimal blockage of light from the lamp. The overall shape of the excitation coil of the Farrall patent is generally that of a surface formed by rotating a bilaterally symmetrical trapezoid about a coil center line situated in the same plane as the trapezoid, but which line does not intersect the trapezoid. However, other suitable coil configurations may be used, such as that described in commonly assigned U.S. Pat. No. 4,812,702 of J. M. Anderson, issued Mar. 14, 1989, which patent is incorporated by reference herein. In particular, the Anderson patent describes a coil having six turns which are arranged to have a substantially V-shaped cross section on each side of a coil center line. Still another suitable excitation coil may be of solenoidal shape, for example.

In operation, RF current in coil 16 results in a time-varying magnetic field which produces within arc tube 14 an electric field that completely closes upon itself. Current flows through the fill within arc tube 14 as a result of this solenoidal electric field, producing a toroidal arc discharge 20 in arc tube 14. The operation of an exemplary electrodeless HID lamp is described in Johnson et al. U.S. Pat. No. 4,810,938, cited hereinabove.

In accordance with the present invention, an additional metal component is added to the metal iodide fill in order to decrease iodine vapor pressure by combining with free iodine during lamp operation to fore a relatively stable iodide and thus avoid arc instability. The additional metal component according to the present invention also emits visible light and thus improves lamp efficacy. Furthermore, the additional lamp component does not reduce silica and thus does not attack, e.g., by etching, the arc tube wall.

Suitable additional metal components according to the present invention include indium, which emits blue light and combines with iodine to form indium iodides, and thallium, which emits green light and combines with iodine to form thallium iodides. An exemplary quantity of the additional metal component according to the present invention is in the range from approximately 0.1 to approximately 2 or 3 mg, with a preferred range being from approximately 0.1 to approximately 1 mg.

EXAMPLE

An electrodeless high intensity discharge lamp has a fill including 4.75 mg of cerium iodide ($CeI_3$), 2.23 mg of sodium iodide (NaI), and 0.5 mg of indium or thallium as an iodine getter.

In one embodiment, the iodine getter according to the present invention is used in combination with a coating 22 for protecting the arc tube. A suitable coating 22 comprises, for example, a single-layer oxide coating, e.g., tantalum oxide ($Ta_2O_5$) or niobium oxide ($Nb_2O_5$), or a multilayer oxide coating such as that described in commonly assigned, copending U.S. patent application of H-R Chang, Ser. No. 796,292, filed Nov. 22, 1991, now U.S. Pat. No. 5,270,615, which is incorporated by reference herein. A coating according to Ser. No. 796,292, filed Nov. 22, 1991, now U.S. Pat. No. 5,270,615, includes a first oxide layer 22 which has a thermal expansion coefficient comparable to that of the fused silica arc tube and is applied directly to the inner surface of the arc tube to provide thermal compatibility and thus prevent cracking of the arc tube wall and spalling of the arc tube coating during lamp operation. At least one additional layer 23 of the multilayer oxide coating provides chemical and thermal stability of the arc tube wall with respect to the lamp fill.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. An electrodeless high intensity discharge lamp, comprising:

a light-transmissive arc tube for containing a plasma arc discharge;

a fill disposed in said arc tube, said fill including an inert starting gas and at least one rare earth metal iodide;

said fill further comprising an additional metal selected from the group consisting of indium and thallium, including combinations thereof, in a sufficient quantity to combine with free iodine to form a stable iodide during lamp operation and thereby avoid a substantial buildup of said free iodine: said free iodine resulting from dissociation and ionization of the metal iodide of said fill: said additional metal emitting visible light during lamp operation.

2. The lamp of claim 1 wherein the quantity of said additional metal is in the range from approximately 0.1 to approximately 3 mg.

3. The lamp of claim 2 wherein the quantity of said additional metal is in the range from approximately 0.1 to approximately 1 mg.

4. The lamp of claim 1, further comprising a protective oxide coating disposed on the inner surface of said arc tube for protecting said arc tube from degradation thereof during lamp operation.

5. The lamp of claim 4 wherein said protective oxide coating comprises a multi-layer oxide coating.

* * * * *